US006871422B2

(12) United States Patent
Blackburn et al.

(10) Patent No.: US 6,871,422 B2
(45) Date of Patent: Mar. 29, 2005

(54) PROTECTIVE, ORTHOTIC INSERT FOR FOOTWEAR

(75) Inventors: Ron L. Blackburn, Encinitas, CA (US); Craig H. Dennis, Encinitas, CA (US)

(73) Assignee: Rhino Tuff, Inc., Encinitas, CA (US)

( * ) Notice: Subject to any disclaimer, the term of this patent is extended or adjusted under 35 U.S.C. 154(b) by 0 days.

(21) Appl. No.: 09/682,732

(22) Filed: Oct. 11, 2001

(65) Prior Publication Data

US 2002/0043005 A1 Apr. 18, 2002

Related U.S. Application Data

(63) Continuation-in-part of application No. 09/687,457, filed on Oct. 17, 2000, now abandoned.

(51) Int. Cl.[7] ..... A43B 13/38; A43B 13/12

(52) U.S. Cl. ..... 36/44; 36/107; 36/72 R; 36/73

(58) Field of Search ..... 36/44, 107, 43, 36/72 R, 73

(56) References Cited

U.S. PATENT DOCUMENTS

| | | | | |
|---|---|---|---|---|
| 1,685,538 A | * | 9/1928 | Glidden et al. | 36/30 R |
| 2,803,895 A | | 8/1957 | Frieder et al. | 36/71 |
| 2,808,663 A | | 10/1957 | Frieder et al. | 36/44 |
| 2,920,008 A | * | 1/1960 | Frieder et al. | 428/102 |
| 3,730,169 A | * | 5/1973 | Fiber | 600/592 |
| 4,020,570 A | * | 5/1977 | Shames | 36/44 |
| 4,133,118 A | * | 1/1979 | Khalsa et al. | 36/83 |
| 4,168,585 A | | 9/1979 | Gleichner | 36/95 |
| 4,231,170 A | | 11/1980 | Griswold | 36/72 |
| 4,271,607 A | | 6/1981 | Funck | 36/30 |
| 4,366,629 A | | 1/1983 | Scherz | 36/4 |
| 4,404,757 A | | 9/1983 | Sweeny | 36/107 |
| 4,435,910 A | | 3/1984 | Marc | 36/44 |
| 4,455,340 A | | 6/1984 | Okina | 428/215 |
| 4,517,981 A | | 5/1985 | Santopietro et al. | 128/581 |
| 4,586,273 A | | 5/1986 | Chapnick | 36/44 |
| 4,597,196 A | * | 7/1986 | Brown | 36/44 |
| 4,633,598 A | | 1/1987 | Moronaga et al. | 36/44 |
| 4,642,912 A | | 2/1987 | Wildman et al. | 36/44 |
| 4,689,898 A | * | 9/1987 | Fahey | 36/43 |
| 4,747,410 A | * | 5/1988 | Cohen | 36/140 |
| 4,793,078 A | * | 12/1988 | Andrews | 36/43 |
| 4,795,357 A | * | 1/1989 | Kosmol et al. | 439/232 |
| 4,888,888 A | | 12/1989 | Ashton | 36/43 |
| 4,897,939 A | | 2/1990 | Harrington | 36/108 |
| 4,910,886 A | | 3/1990 | Sullivan et al. | 36/44 |

(Continued)

FOREIGN PATENT DOCUMENTS

GB 2264221 * 8/1993

OTHER PUBLICATIONS

ANSI Z41–1999, Sole Puncture Resistant Protective Footwear, pp. 19–22.

*Shop Talk*, (visited May 7, 2002) <http://www.empirestatecarpenters.org/shoptalk.htm>.

The Tool Chest, *Work Boots*, (visited May 7, 2002) <http://www.empirestatecarpenters.org/tool chest.htm>.

The Tool Chest, *Safety Toes*, (visited May 7, 2002) <http://www.empirestatecarpenters.org/tool chesta.htm>.

Safety Mid–Soles, *The Stopper* (2001) <http://www.betash-im.com>.

Beta Sole (website date unknown) <http://www.besasole.com>.

*Primary Examiner*—M. D. Patterson

(74) *Attorney, Agent, or Firm*—Fish & Richardson P.C.

(57) ABSTRACT

A preferably three layer protective orthotic insert for footwear is provided. According to one embodiment, a bottom layer is a single stainless steel sheet. A middle layer is a polyurethane layer, shaped to the contour of the bottom of a foot and including orthotic supports, disposed over the single stainless steel sheet. And a top layer is a membrane secured to the molded polyurethane layer. A method for making the protective orthotic insert is also provided.

5 Claims, 2 Drawing Sheets

U.S. PATENT DOCUMENTS

| | | | | | |
|---|---|---|---|---|---|
| 4,930,232 | A | | 6/1990 | Engle | 36/44 |
| 4,942,679 | A | * | 7/1990 | Brandon et al. | 36/102 |
| 4,955,148 | A | | 9/1990 | Padilla | 36/44 |
| 5,003,709 | A | | 4/1991 | Okayasu et al. | 36/107 |
| 5,285,583 | A | | 2/1994 | Aleven | 36/44 |
| 5,463,824 | A | * | 11/1995 | Barna | 36/44 |
| 5,546,680 | A | | 8/1996 | Barma et al. | 36/108 |
| 5,611,153 | A | * | 3/1997 | Fisher et al. | 36/43 |
| 5,996,255 | A | * | 12/1999 | Ventura | 36/44 |
| 5,996,257 | A | | 12/1999 | Harrison | 36/72 |
| 6,131,311 | A | * | 10/2000 | Brown et al. | 36/43 |
| 6,178,664 | B1 | * | 1/2001 | Yant et al. | 36/44 |
| 6,286,232 | B1 | * | 9/2001 | Snyder et al. | 36/43 |

* cited by examiner

PROTECTIVE, ORTHOTIC INSERT FOR FOOTWEAR

CROSS REFERENCE TO RELATED APPLICATIONS

This application is a continuation-in-part of U.S. patent application Ser. No. 09/687,457, filed Oct. 17, 2000 now abandoned, under the names of the same inventors, and entitled PUNCTURE RESISTANT ORTHOTIC INSOLE. Priority is claimed to this earlier filed U.S. Patent Application under 35 United States Code § 120, and the earlier filed application is incorporated herein by reference in its entirety.

BACKGROUND

1. Field of the Invention

The invention pertains to shoe inserts, and more particularly to protective shoe inserts.

2. Background Information

Laborers, technicians, supervisors, project managers and other professionals in industrial and construction industries often work in hazardous environments. Job sites and facilities are generally not open to the public and such facilities are not continually cleaned and made safe of dangerous conditions. As such, shards of glass, shreds of metal and other rigid construction materials, in particular nails, pose a continuing threat of injury to the feet of workers in these environments.

To overcome such hazards, it has been proposed, and it is commonly practiced, that the sole of a work boot or safety shoe be integrally constructed of multiple layers of a high tensile strength synthetic or polymeric fibers, such as Kevlar (™) In work boots. U.S. Pat. No. 5,996,225, issued to George Ventura, shows such a technique. Drawbacks, however, to this technique include that it adds cost and complexity to the design of a work boot insole. A similar solution is proposed in U.S. Pat. No. 5,285,583, by Albertus A. W. Alven, of Markdale, Canada, as well in a series of U.S. Patents authored by L. P. Frieder et al., for instance U.S. Pat. Nos. 2,803,895, 2,808,663, and 2,920,008. Each of these patents teach that multiple stacked, resin-impregnated, fibrous laminates are needed to prevent penetration by sharp objects.

While also an integrally fabricated portion of the protective footwear sole, U.S. Pat. No. 4,271,607, issued to Herbert Funck of Germany, shows that a two-part, yet single-layered, prefabricated steel inlay can be used as a protective shield.

Because the metal inlay is integrally molded into the footwear sole, there is the risk that movement and flexing on the integral and flexing will damage the interior lining and sole of the protective footwear. Appreciating this problem Funck, requires a grove and two-part lip molding combination in the forward end (toe end) of the sole to prevent movement, and a cup shaped holder secured to the underside of the steel inlay at the rear end (heel end) to facilitate alignment within the sole assembly. A further drawback is that by incorporating the metal inlay into the sole of the footwear, only about 80% of the bottom surface of a foot is protected by the metal inlay.

While either a separate insole insert for footwear, or an integrally molded part at manufacture, U.S. Pat. No. 6,178,664, issued to Robert D. Yant et al., the '664 patent shows another multi-layered metal sheet assembly designed to protect the sole of a shoe from puncture by a sharp object.

As is the case with other multi-layered protective layer assemblies, the '664 patent requires an intricate manufacturing process, involving the stamping of multiple metal sheets and spot welding each metal sheet to the next. The end result of the '664 patent being a variable thickness, multi-layered metal sheet assembly.

SUMMARY

A preferably three layer protective orthotic insert for footwear is provided.

According to one embodiment, a bottom layer is a single steel sheet. A middle layer is a cushion layer, shaped to the contour of the bottom of a foot and including orthotic supports, disposed over the single steel sheet. And a top layer is a membrane secured to the cushion layer to one embodiment, a metatarsal support region integrated with the cushion layer. In another embodiment, the cushion layer is further characterized by a lip that extends upwardly and outwardly relative to the single steel sheet.

A method for making the same is also provided. The method comprises forming a cushion layer that provides orthotic support for a foot; attaching a membrane to a top surface of the cushion layer; trimming the membrane to match a perimeter of the top surface of the cushion layer; and stamping a single metal sheet from stainless spring steel, the metal sheet having a top surface configured to receive a bottom surface of the cushion layer, and a bottom surface configured to engage a top surface of an interior cavity of the footwear.

In one embodiment, the method is further characterized by applying bonding material to the top surface of the metal sheet; and placing the metal sheet into a mold for the cushion layer; wherein the step of forming the cushion layer is performed directly over the metal sheet. In other embodiment, the method includes brushing the top surface of the metal sheet prior to placing the placing the metal sheet into the mold for the cushion layer. In still another embodiment, the method includes deburring the metal sheet prior to placing the metal sheet into a mold for the cushion layer.

BRIEF DESCRIPTION OF DRAWINGS

The description is aided by way of the following figures, in which like reference numerals on different figures refer to the same or equivalent elements as in other figures.

DETAILED DESCRIPTION OF THE PREFERRED EMBODIMENTS

We have invented a protective, orthotic insert preferably comprising three layers. A bottom layer comprises a single sheet of stainless steel. A middle layer comprises a cushion layer, for instance made of polyurethane, neoprene, PVC foam, EVA, or an equivalent support material, configured to support the heel and arch of the wearer's foot. A top layer comprises a membrane, such as a skin (for example open cell polyurethane), cloth, or another synthetic material that protects the middle layer from direct contact with the inserted foot, and, ideally, minimizes unsightly discoloration and unpleasant odor. The methods and techniques described herein achieve an inexpensive protective, orthotic insert for footwear, in which the stainless steel sheet preferably covers in excess of 90% of the bottom of a foot residing above the insert.

Figure 1:
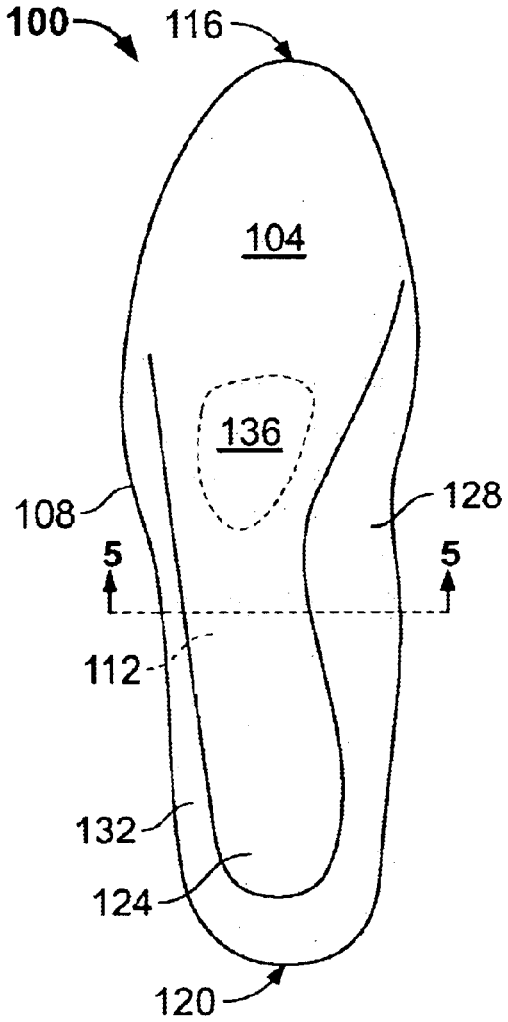
FIG. 1 is a top view of the protective insert.

Turning first to FIG. 1, it is a top view of the protective insert 100. The insert 100 includes a forward end (the toe end) 116, and a rear end (the heel end) 120. A thin top layer comprising a cloth-like material 104 is directly seen from this view as it resides over a middle layer 108. The top layer 104 is preferably constructed of Cambrelle+ (™), which is commercially available from the Faytex Corporation in Weymouth, Mass. We have found that this material best achieves the prevention of discoloration and odor, as well, it wicks out moisture and minimizes friction with the foot.

As viewed from the top, a number of features, not necessarily attributable to the top layer 104 are visible. For instance, a lip 132 rises up around the outer perimeter of the insert 100. The lip 132 projects outwardly, slightly away from the interior portion of the insert 100, to keep the inserted foot centered on top of the insert, and to further provide horizontal support for the insert 100 when it is inserted into footwear, such as a tennis shoe, work boot, or even a dress shoe. This keeps the insert snug into the footwear and prevents lateral or back and forth motion.

According to one embodiment, the lip 132 does not need to completely surround the perimeter of the insert 100, but rather, it is sufficient if there is no upwardly extending lip region in the vicinity of the toe end 116 of the insert 100.

In addition to the lip 132, also visible in FIG. 1 is the arch support 128, which also rises up from the bottom layer 112. The top surface 104 reaches its peak height at approximately the crest of the lip region over the arch support 128.

Also visible is the heel support 124, which can have a bulbous shape that rises upwardly from the lowest portions of the top layer 104 at the heel end 120 of the insert 100. Notably, the lip 132 is thicker (horizontally) and deeper (vertically) at the heel end 120 of the insert than in most other regions, excepting the arch support 128.

According to one embodiment, an optional metatarsal support region 136 is also part of the insert 100. The metatarsal region 136 is preferably integrally molded from the middle layer (discussed below), but the metatarsal region 136 can also be built up after manufacture, for instance by creating a pocket beneath the top layer 104 in which an orthotic cushion can be inserted or received.

According to one embodiment, the pocket for the metatarsal support 136 is formed by a cut into the top (104) and middle (108) layers of the insert 100, which runs parallel with a line formed between the toe (116) and heel (120) ends of the insert 100. Alternatively, the metatarsal support 136 can be a separate element that is disposed over and bonded to the bottom layer 112 before the middle layer 108 is added.

Figure 2:
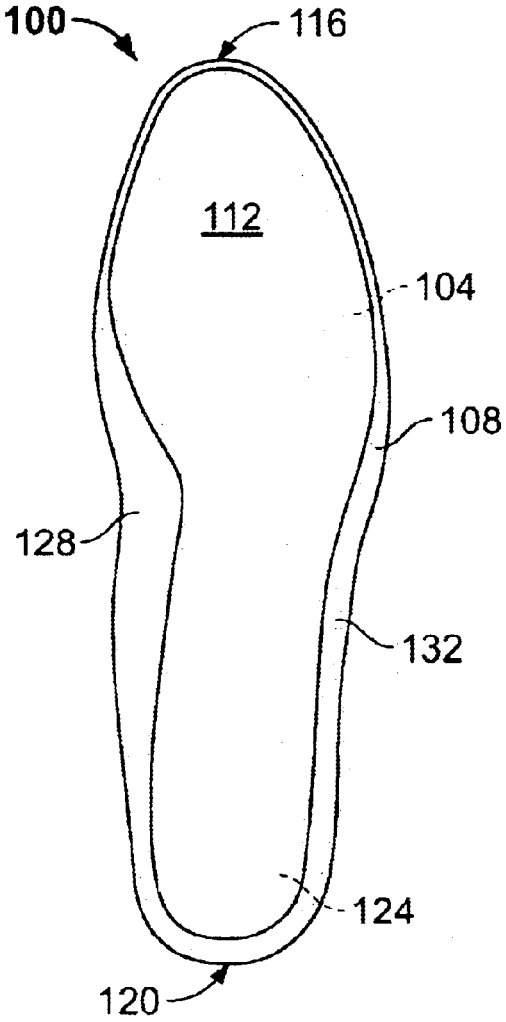
FIG. 2 is a bottom view of the protective insert.

Turning next to FIG. 2, we depict a bottom view of the insert 100. The bottom layer 112 is prominent in this view, but also visible is the middle layer 108, and more particularly the lip 132 and arch support 128.

According to one embodiment, the bottom layer 112 comprises a single layer stainless steel shim stock or stainless spring steel of a thickness between 0.020 and 0.025 inches. We have found that spring steel is a superior construction material, over Kevlar (™) and other synthetic materials.

Not only does the spring steel provide an improved puncture resistant quality, but it is largely impervious to the pH of the foot. And in this and the combination of our protective insert assembly lies another advantage of our solution over the integrally molded, multi-layered sole assemblies of prior solutions: The multi-layered solutions run the risk of water and sweat finding their way into the spaces between the layers. With time, the water causes deterioration, such as rust and mold, of protective layers, if not the entire shoe sole. Since the prior systems are integrally molded or embedded into the sole, they are not visible and cannot be inspected. Thus fatigue deterioration may go unnoticed, thereby increasing the risk of injury to the foot.

Moreover, using a thickness that preferably does not exceed 0.025 inches, the single spring steel layer 112 has the added characteristic of memory. By memory we mean that the bottom layer 112 tends to return to its constructed position and returns kinetic energy to the wearer as the spring steel layer 112 bends and is then released by walking action.

Figure 3:
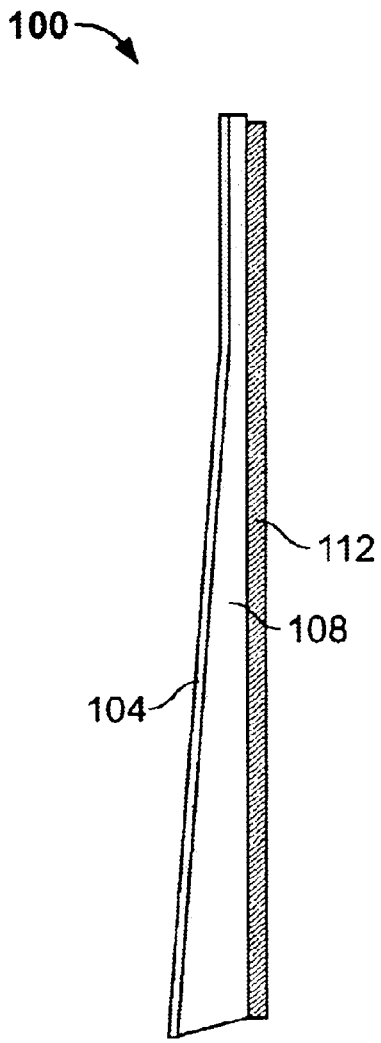
FIGS. 3 and 4 are side views of the protective insert.
Figure 4:
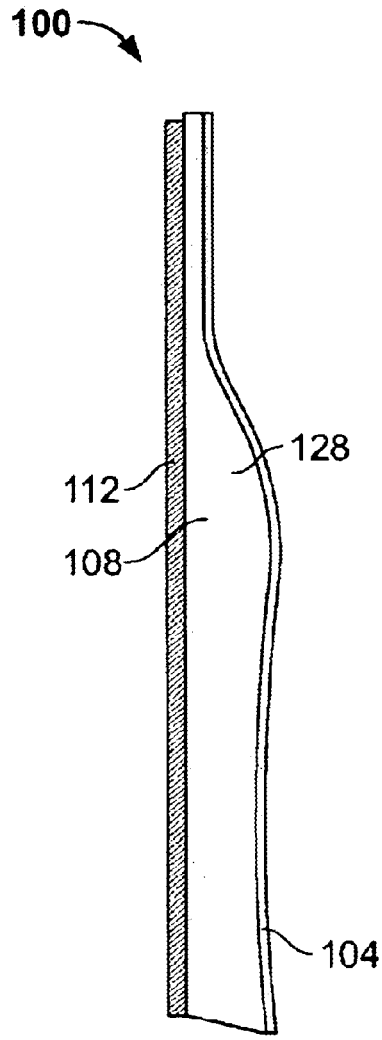
Figure 5:
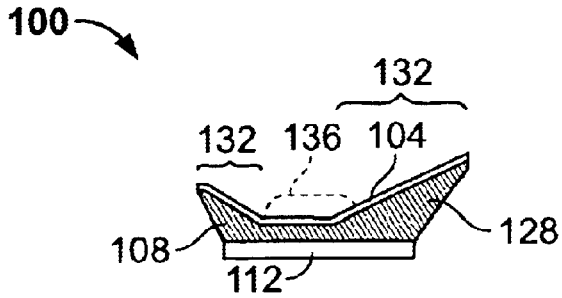
FIG. 5 is a cross-sectional view of the protective insert.

FIG. 2 also depicts a cross-section of the insert 100. This cross-section is depicted in FIG. 5, while FIGS. 3 and 4 depict side views of the insert. In each of the figures, the proportions of the insert assembly are exaggerated for the purpose of illustration. The actual dimensions in these drawings, as well in FIGS. 1 and 2, are not to scale.

As conceived by the inventors, the middle layer 108, structurally forms the orthotic characteristic of the insert 100. According to one embodiment, the middle layer conforms to U.S. military specifications for orthotic inserts. Commercially available, pre-manufactured units are also acceptable, such as the Mid-Pro Mold Thick-toe, from ATP Manufacturing LLC, in North Smithfield, R.I. When a pre-manufactured middle layer 108 is employed, for instance the Mid-Pro Mold, it should be glued to the bottom layer 108 with an adhesive contact cement that is specifically chemical formulated to bond closed cell polyurethane to steel. For instance, part no. E-2150, a commercially available contact cement, is available from Worth Industries, in Nasoun, N.H. can be employed.

Returning to FIG. 5, it is a cross sectional view of section A—A, which is a view toward the heel side 120 of the insert 100. The three layers of the preferred embodiment of the protective, orthotic shoe insert 100 are plainly visible—namely: a single stainless steel sheet, which forms the bottom layer 112, a molded polyurethane layer, which forms the middle layer 108, which is shaped to the contour of the bottom of a foot and disposed over the bottom layer 112, and an air and water permeable membrane, which forms the top layer 104.

Also visible is that the perimeter of the bottom surface of the molded polyurethane layer (middle layer 108), and the perimeter of the top surface of the single stainless steel sheet (bottom layer 112), are roughly equal—or at least that the perimeter of the stainless steel sheet is less than the perimeter of the bottom surface of the polyurethane layer. Note how the lip 132 slopes in an outwardly direction from the bottom layer 112.

According to one embodiment, the insert 100 is formed by the following processes. First, a single stainless steel sheet is stamped from stainless steel shim stock, for example 301 stainless steel full hard. The stamped single stainless steel sheet preferably has a thickness between 0.020 and 0.025 inches. According to one embodiment, the stainless steel sheet can be manually or automatically inspected to remove any sharp burrs or imperfections—that is, it can be deburred and then polished.

Next, the stainless steel sheet is inserted into a mold, where a polyurethane orthotic insole is formed over the top surface of the stainless steel sheet. The two layered insert is then allowed to cure. If needed, a Cambrelle (™) membrane is disposed over the top surface of the polyurethane. According to one embodiment, the top surface of the stainless steel sheet is mechanically or chemically etched and a bonding material sprayed on the top surface before the polyurethane is formed over top surface of the stainless steel sheet in the mold.

After the layers of the orthotic insole are formed, the orthotic insole can be trimmed to remove any excess materials or imperfections along the perimeter (for example about lip 132).

Note that it is possible that a two level cushion layer can be constructed of polyurethane to form the cushion layer and the membrane. For instance, an open cell polyurethane can be used to create the cushion layer, after the steel sheet is inserted into the mold, and a second polyurethane layer, for instance a closed cell polyurethane layer, can be molded directly over the open cell polyurethane layer. This process of forming the top layer can be called a "skinning" process.

Furthermore, if the metatarsal support 136 is not integrally molded with the middle layer 108, which is what is preferred, then the necessary mechanical or structural attachment means can be made after the three primary layers of the insert 100 are formed. It is also possible to manufacture an insert as described above without a lip region, such as an executive model, that slides into a dress shoe and does not provide the support described above with reference to the figures. In such an embodiment, a two or three layer insert, preferably a two layer insert, is the desired end product.

By making the insert 100 a separately added feature of a shoe, rather than integrating the protective qualities into the manufacture of the shoe, we achieve a greater surface area of protection of the foot than prior systems. Moreover, our single layer stainless steel sheet is less costly to manufacture, and achieve a good balance between puncture resistance and comfort of use. Thus, our solution has considerable advantage to those who work in construction and industrial industries, or in environments where the risk of material puncturing a foot is high. We note that our invention is especially advantageous for diabetics, for whom a nail injury to the foot can prove fatal.

What is claimed is:

1. A removable insert for footwear consisting of:

a flat single stainless steel sheet having a uniform thickness of approximately 0.020–0.025 inches;

a non-uniform polyurethane layer, shaped to the contour of the bottom of a foot and including orthotic supports and a metatarsal support region therein, disposed completely over the single stainless steel sheet; and an air and water permeable membrane secured to the molded polyurethane layer.

2. The insert of claim 1, wherein the polyurethane layer forms a bottom perimeter that is approximately equal to a perimeter of the single stainless steel sheet.

3. An exactly three-layered insert configured to be removably placed into footwear, the insert consisting of:

a single, flat, planar stainless steel sheet having a uniform thickness between 0.020 and 0.025 inches;

a non-uniform cushion layer, shaped to the contour of the bottom of a foot and including orthotic supports and a lip portion that extends upwardly and outwardly relative to a perimeter of the single stainless steel sheet, over which the cushion layer is disposed; and a membrane secured to the cushion layer.

4. The insert of claim 3, wherein the cushion layer has a bottom perimeter that is approximately equal to the perimeter of the single stainless steel sheet, and a metatarsal support region integrated with the cushion layer.

5. A three-layer protective, orthotic device for a shoe that is configured to be removably inserted therein, the three layers comprising a protective layer means, an orthotic layer means, and a membrane layer means, each disposed, respectively, over the previous layer, wherein:

the protective layer means consists of a flat piece of stainless steel of a uniform thickness between 0.020 and 0.025 inches and stamped in the shape of a foot; and the orthotic layer means consists of a variable thickness polyurethane having a shape configured to provide support to the bottom of a foot including a metatarsal support region, and an outwardly extending lip portion which extends upwardly and outwardly around the perimeter of the orthotic layer which is configured to support the sides of a foot positioned on the protective, orthotic device.

* * * * *